US010274153B2

(12) United States Patent
Kim et al.

(10) Patent No.: US 10,274,153 B2
(45) Date of Patent: Apr. 30, 2019

(54) LAMP FOR VEHICLE

(71) Applicant: SL Corporation, Daegu (KR)

(72) Inventors: Jongwoon Kim, Gyeongsangbuk-do (KR); Nakjung Choi, Gyeongsangbuk-do (KR); Hyeongdo Kim, Gyeongsangbuk-do (KR); Kihae Shin, Gyeongsangbuk-do (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 16/037,182

(22) Filed: Jul. 17, 2018

(65) Prior Publication Data

US 2019/0032881 A1 Jan. 31, 2019

(30) Foreign Application Priority Data

Jul. 27, 2017 (KR) ..... 10-2017-0095396

(51) Int. Cl.
*F21S 41/40* (2018.01)
*F21S 41/20* (2018.01)

(52) U.S. Cl.
CPC ..... *F21S 41/40* (2018.01); *F21S 41/285* (2018.01)

(58) Field of Classification Search
CPC ..... F21S 41/40; F21S 41/285
See application file for complete search history.

(56) References Cited

U.S. PATENT DOCUMENTS 6,061,179 A * 5/2000 Inoguchi ..... G02B 27/2214 359/464
7,064,895 B2 * 6/2006 Morishima ..... G02B 27/2214 359/463
7,336,326 B2 * 2/2008 Kim ..... G02F 1/1323 349/95
2002/0034710 A1 * 3/2002 Morris ..... G02B 3/0043 430/321
2003/0020883 A1 * 1/2003 Hara ..... G03B 21/006 353/31
2008/0218853 A1 * 9/2008 El-Ghoroury ..... G03B 21/625 359/449
2014/0321137 A1 * 10/2014 Chen ..... G02B 6/003 362/511
2014/0362600 A1 * 12/2014 Suckling ..... F21S 41/663 362/583
2016/0178154 A1 * 6/2016 Sapt ..... G02B 19/0019 362/521
2016/0369965 A1 * 12/2016 Park ..... F21V 7/0033
2018/0038567 A1 * 2/2018 Park ..... F21S 41/141

* cited by examiner

*Primary Examiner* — Donald L Raleigh
(74) *Attorney, Agent, or Firm* — Mintz Levin Cohn Ferris Glovsky and Popeo, P.C.; Kongsik Kim

(57) ABSTRACT

Provided is a lamp for a vehicle which is capable of forming a beam pattern having a cutoff line with a moderate sharpness. The lamp includes a light source portion, a first lens portion with a plurality of micro incident lenses, a second lens portion with a plurality of micro exit lenses corresponding to the plurality of micro incident lenses, respectively, and a shielding portion which includes a plurality of shields which form a plurality of illumination regions for forming a beam pattern by obstructing a portion of light which is incident onto each of the plurality of micro exit lenses. In particular, upper boundary lines of illumination regions formed by a first set of the plurality of shields are formed in positions different from those of upper boundary lines of illumination regions formed by a second set of the plurality of shields.

11 Claims, 17 Drawing Sheets

LAMP FOR VEHICLE

CROSS-REFERENCE TO RELATED APPLICATION

This application claims priority from Korean Patent Application No. 10-2017-0095396 filed on Jul. 27, 2017, the disclosure of which is incorporated herein by reference in its entirety.

BACKGROUND

1. Field of the Disclosure

The present disclosure relates to a lamp for a vehicle, and more particularly, to a lamp for a vehicle which is capable of forming a beam pattern having a cut-off line with a moderate sharpness.

2. Description of the Related Art

Generally, a vehicle includes a variety of types of lamps having an illumination function for recognizing an object disposed proximate to the vehicle during low light conditions (e.g., night) or a signaling function for informing other vehicles or road users proximate to the vehicle of a driving state of the vehicle.

For example, a headlamp, a fog lamp, and the like generally have the illumination function. A turn signaling lamp, a tail lamp, a brake lamp, a side marker lamp, and the like generally have the signaling function. Also, installation criteria and specifications for the lamps are regulated by law so that each lamp can adequately perform its function.

Recently, studies for reducing a size of a lamp for a vehicle by using a micro lens having a relatively short focal distance have been actively performed.

Among lamps for a vehicle, a headlamp, which forms a low beam pattern or a high beam pattern to ensure a front field of vision for a driver during nighttime driving, performs an important function for driving safety.

In particular, a low beam pattern forms a certain cut-off line to prevent a driver of a vehicle in front or a vehicle approaching in an opposite lane from being blinded. As the sharpness of the cut-off line increases, a contrast between an area toward which light is emitted and an area toward which light is not emitted is increased to cause a driver to be distracted such that a possibility of car accidents may increase.

Accordingly, it is necessary to allow the cut-off line of the low beam pattern to have a moderate sharpness to prevent the driver from being distracted while reducing the contrast between the area toward which light is emitted and the area toward which light is not emitted.

The above information disclosed in this section is merely for enhancement of understanding of the background of the disclosure and therefore it may contain information that does not form the prior art that is already known in this country to a person of ordinary skill in the art.

SUMMARY

Aspects of the present disclosure provide a lamp for a vehicle, which is capable of reducing differences by allowing a boundary line of a beam pattern to have a moderate sharpness.

Aspects of the present disclosure also provide a lamp for a vehicle which is capable of forming different beam patterns at the same time.

It should be noted that objects of the present disclosure are not limited to the above-described objects, and other objects of the present disclosure will be apparent to those skilled in the art from the following descriptions.

According to some aspects of the present disclosure, a lamp for a vehicle may include a light source portion, a first lens portion with a plurality of micro incident lenses onto which light generated by the light source portion is incident, a second lens portion with a plurality of micro exit lenses that corresponds to the plurality of micro incident lenses, respectively, and a shielding portion with a plurality of shields which is configured to form a plurality of light distribution areas for forming a first beam pattern by obstructing a portion of light which is incident onto each of the plurality of micro exit lenses. Here, upper boundary lines of illumination regions formed by a first set of the plurality of shields may be formed in positions different from those of upper boundary lines of illumination regions formed by a second set of the plurality of shields.

In particular, the upper boundary lines of the first set of the plurality of illumination regions may form a cut-off line of the first beam pattern, and the upper boundary lines of the second set of the plurality of illumination regions may be disposed below the cut-off line of the first beam pattern by a predetermined offset. Accordingly, the cut-off line of the first beam pattern may have a brightness which gradually increases toward a downward direction.

Furthermore, each of the plurality of shields may include an edge portion for forming the upper boundary line of each of the plurality of illumination regions, and at least parts of the edge portions of the first set of the plurality of shields may have heights different from those of the edge portions of the second set of the plurality of shields. More specifically, the edge portion may include an inclined portion, a first obstruction edge portion which horizontally extends from a bottom end of the inclined portion, and a second obstruction edge portion which horizontally extends from a top end of the inclined portion, and at least one of the first obstruction edge portion or the second obstruction edge portion of the edge portions of the first set of the plurality of shields may have heights different from those of the edge portions of the second set of the plurality of shields.

According to other aspects of the present disclosure, a lamp for a vehicle may include a light source portion, a first lens portion with a plurality of micro incident lenses onto which light generated by the light source portion is incident, a second lens portion with a plurality of micro exit lenses that correspond to the plurality of micro incident lenses, respectively, and a shielding portion with a plurality of shields which is configured to form a plurality of light distribution areas for forming a first beam pattern by obstructing a portion of light which is incident onto each of the plurality of micro exit lenses. Further, each of the plurality of shields may include a light transmission portion to form a second beam pattern. The first beam pattern may be a low beam pattern, and the second beam pattern may be a signal beam pattern formed above the low beam pattern.

The light transmission portion may be formed as an open area to allow light to pass therethrough, and a first set of the plurality of shields may include the open area having a different size, a different shape, and/or a different position from a second set of the plurality of shields. Further, at least part of a boundary line of the second beam pattern may have a brightness which gradually increases toward an inside direction.

Alternatively, the light transmission portion may include a transmission area which transmits light and an obstruction area which obstructs light, which may be alternatingly arranged in at least one direction. Further, a first set of the plurality of shields may have at least one of the transmission area or the obstruction area formed at a different position from a second set of the plurality of shields.

Details of other examples are included in a detailed description and drawings.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
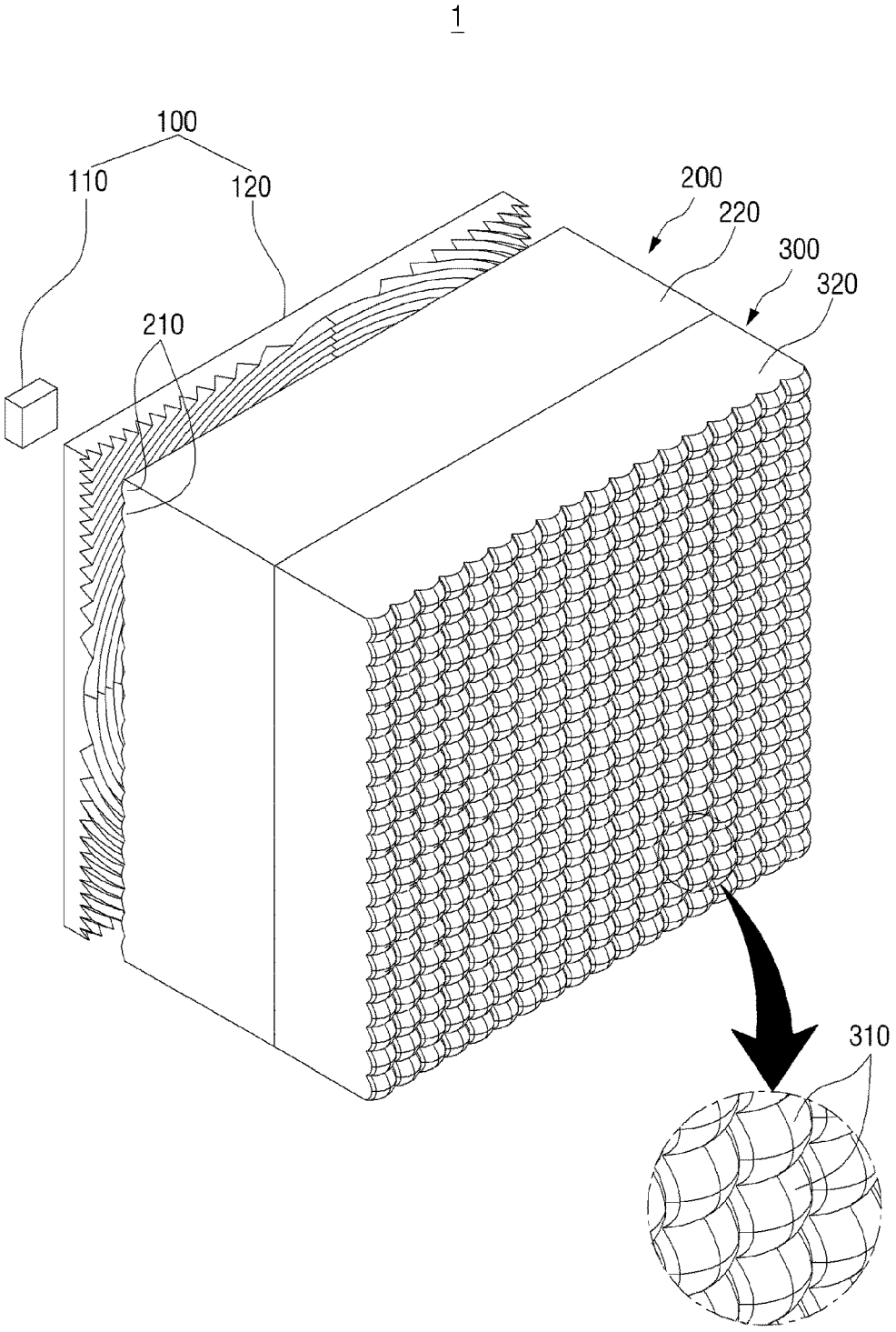
FIGS. 1 and 2 are perspective views of a lamp for a vehicle according to some exemplary embodiments of the present disclosure.

Advantages and features of the present disclosure and a method of achieving the same will become apparent with reference to the attached drawings and embodiments described below in detail. However, the present disclosure is not limited to the embodiments described below and may be embodied with a variety of different modifications. The embodiments are merely provided to allow one of ordinary skill in the art to completely understand the scope of the present disclosure and are defined by the scope of the claims. Throughout the specification, like reference numerals refer to like elements.

Accordingly, in some embodiments, well-known operations of a process, well-known structures, and well-known technologies will be not described in detail to avoid obscuring understanding of the present disclosure.

The terms used herein are for explaining embodiments but are not intended to limit the present disclosure. Throughout the specification, unless particularly defined otherwise, singular forms include plural forms. The terms "comprises" and/or "comprising" are used herein as meanings which do not exclude presence or addition of one or more other components, stages, and/or operations in addition to stated components, stages, and/or operations. Also, "and/or" includes each and one or more combinations of stated items.

Also, embodiments disclosed herein will be described with reference to perspective views, cross-sectional views, side views, and/or schematic diagrams which are exemplary views of the present disclosure. Accordingly, modifications may be made in the forms of exemplary views by manufacturing technology, allowable error, and/or the like. Accordingly, the embodiments of the present disclosure will not be limited to particular forms shown in the drawings and include changes made by a manufacturing process. Also, throughout the drawings of the present disclosure, components may be slightly exaggerated or reduced in consideration of convenience of description.

Hereafter, a lamp for a vehicle according to some exemplary embodiments of the present disclosure will be described with reference to the drawings.

Figure 2:
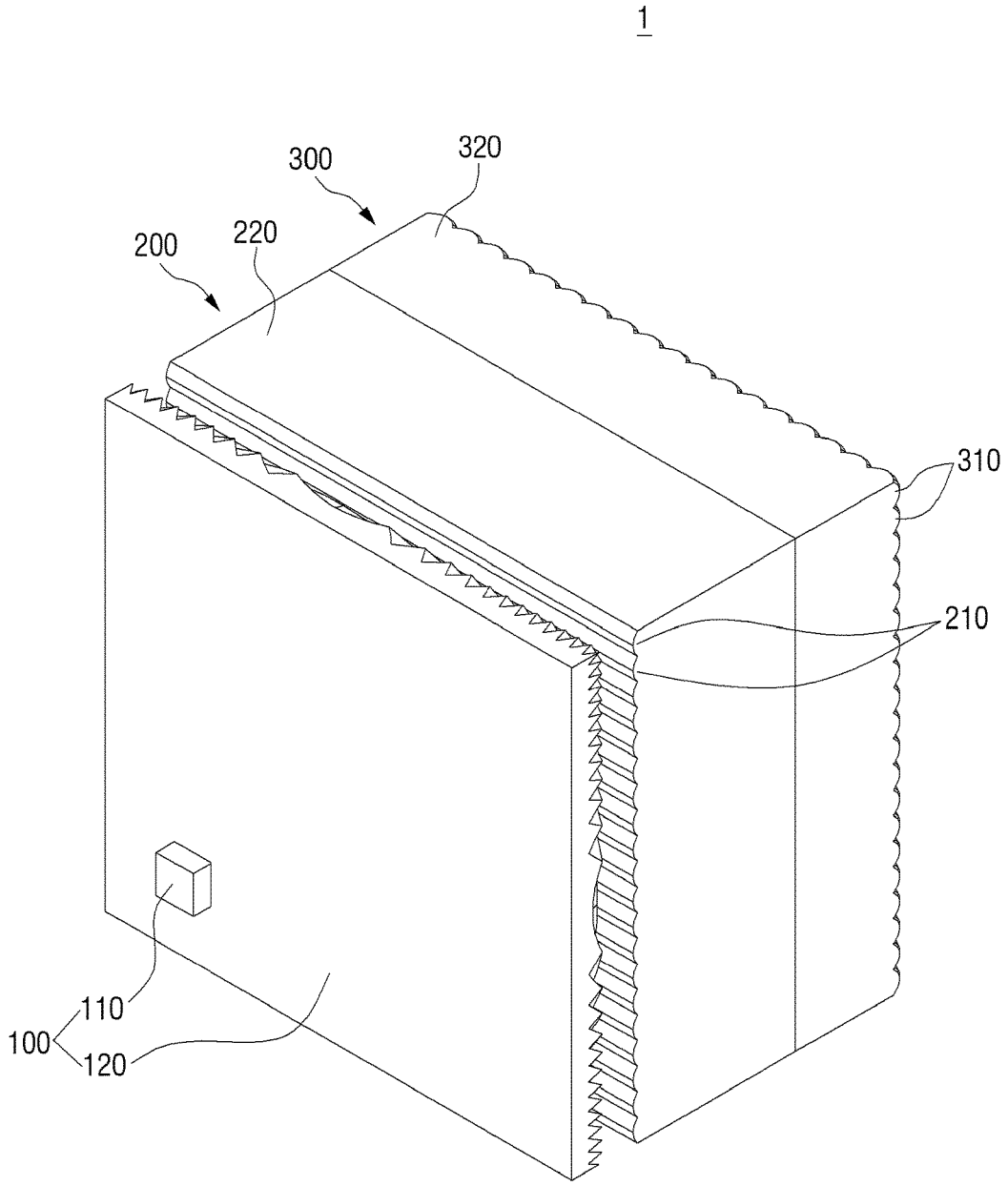
Figure 3:
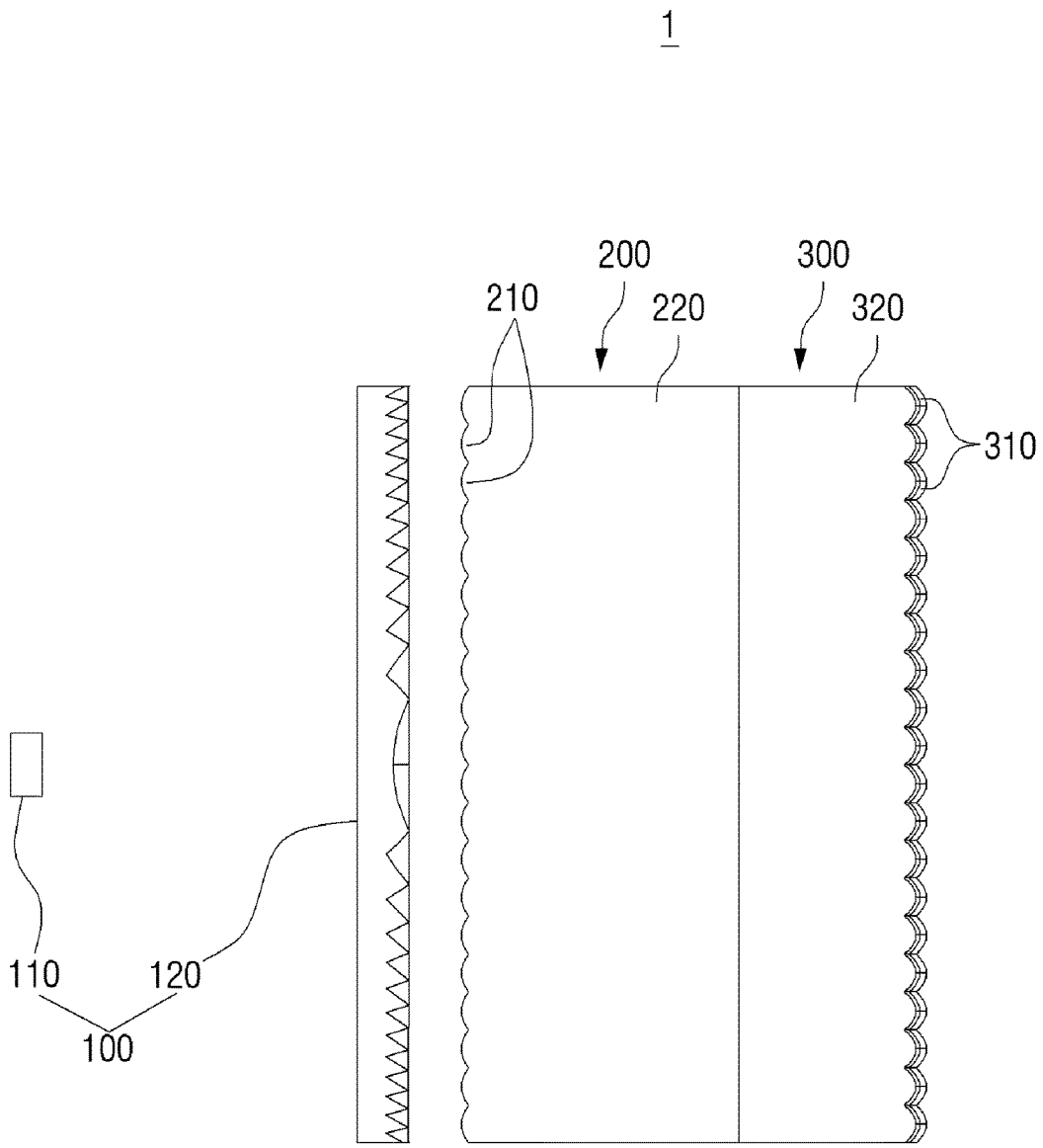
FIG. 3 is a side view of the lamp for the vehicle according to some exemplary embodiments of the present disclosure.
Figure 4:
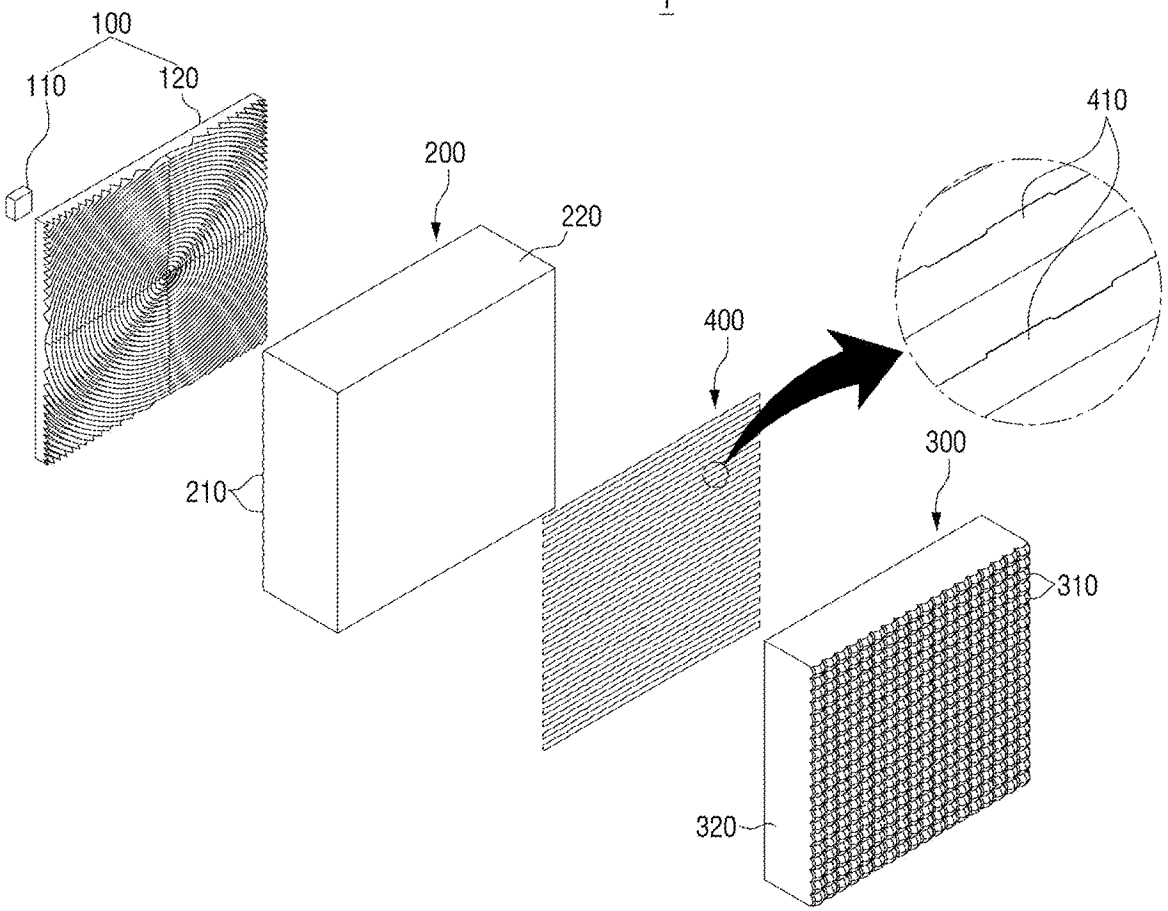
FIGS. 4 and 5 are exploded-perspective views of the lamp for the vehicle according to some exemplary embodiments of the present disclosure.
Figure 5:
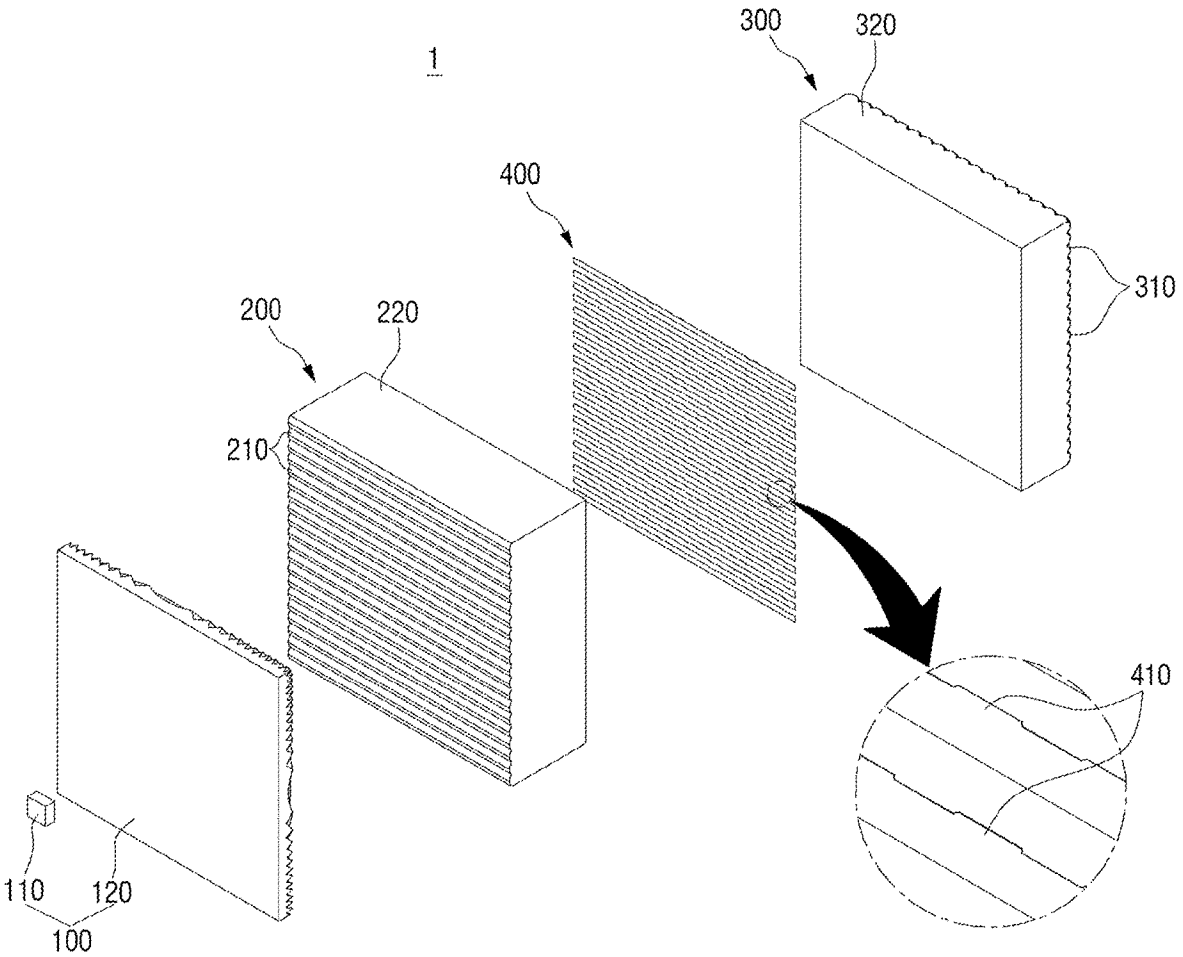

FIGS. 1 and 2 are perspective views of a lamp for a vehicle according to some exemplary embodiments of the present disclosure, FIG. 3 is a side view of the lamp for the vehicle according to some exemplary embodiments of the present disclosure, and FIGS. 4 and 5 are exploded-perspective views of the lamp for the vehicle according to some exemplary embodiments of the present disclosure.

Referring to FIGS. 1 to 5, a lamp 1 for a vehicle according to some exemplary embodiments of the present disclosure may include a light source portion 100, a first lens portion 200, a second lens portion 300, and a shielding portion 400.

In the exemplary embodiments of the present disclosure, the lamp 1 may be a headlamp for ensuring a front field of vision in a vehicle when the vehicle is traveling in low light conditions (e.g., night time) by emitting light in a driving direction or traveling through a dark place such as a tunnel and the like, but the lamp is not limited thereto. The lamp 1 may be used not only as a headlamp, but also as any of a variety of lamps installed in a vehicle such as a tail lamp, a brake lamp, a fog lamp, a position lamp, a turn-signal lamp, a daytime running lamp, a backup lamp, and the like.

Additionally, the exemplary embodiments of the present disclosure will be described regarding the lamp 1 as a headlamp that forms a low beam pattern having a certain cut-off line to prevent a driver of a vehicle in front or a vehicle approaching in an opposite lane from being blinded, but it is merely an example for aiding in understanding the present disclosure. Therefore, the lamp 1 is not limited thereto but may form a variety of beam patterns according to use thereof and may form two or more beam patterns simultaneously.

The light source portion 100 may include a light source 110 and a light guide portion 120. In the exemplary embodiments of the present disclosure, a semiconductor light emitting diode (LED) such as an LED lamp may be used as the light source 110. However, the light source 110 is not limited thereto, and a variety of types of light sources such as a bulb and the like may be used as the light source 110 in addition to the semiconductor LED. Depending on the type of the light source 110, components such as a reflector and the like, which reflects the light generated by the light source 110 toward the first lens portion 200, may be additionally included.

The light guide portion 120 may guide light, which is generated by the light source 110 at a certain light irradiation angle, to the first lens portion 200 by adjusting an optical path of the light to be parallel to an optical axis of the light source 110. The optical axis of the light source 110 may represent a line which perpendicularly passes a center of a light emitting surface of the light source 110, and an optical axis of the light source portion 100 may represent the optical axis of the light source 110.

The light guide portion 120 may reduce the light loss by allowing the light generated by the light source 110 to be incident onto the first lens portion 200 as much as possible, and allow the light which is incident onto the first lens portion 200 to be uniformly incident onto the first lens portion 200 overall by adjusting the optical path of the light to be parallel to the optical axis of the light source 110.

In the exemplary embodiments of the present disclosure, a Fresnel lens configured as a lens having a shape of plural rings may be used as the light guide portion 120 to reduce a thickness thereof and to adjust the optical path of the light generated by the light source 110 to be parallel to the optical axis of the light source 110. However, the present disclosure is not limited thereto, and a variety of types of lenses such as a collimator lens and the like which are capable of adjusting the optical path of the light generated by the light source 110 may be used as the light guide portion 120.

The first lens portion 200 may include a plurality of micro incident lenses 210 onto which the light generated by the light source portion 100 is incident. Incident surfaces of the plurality of micro incident lenses 210 may collectively form an incident surface of the first lens portion 200, and exit surfaces of the plurality of micro incident lenses 210 may collectively form an exit surface of the first lens portion 200.

In the exemplary embodiments of the present disclosure, the plurality of micro incident lenses 210 may be integrally formed as a single body on a surface of a first light guide 220 that is made of a light transmission material, which faces the light source portion 100. However, the first light guide 220 is intended to form the first lens portion 200 and the second lens portion 300 as a single body and may be omitted when the first lens portion 200 and the second lens portion 300 are formed separately.

Further, each of the plurality of micro incident lenses 210 may be a semicylindrical lenticular lens which extends in a horizontal direction. In particular, the plurality of micro incident lenses 210 may be arranged in a direction perpendicular to the direction in which the lenticular lenses extend.

The second lens portion 300 may include a plurality of micro exit lenses 310. Incident surfaces of the plurality of micro exit lenses 310 may collectively form an incident surface of the second lens portion 300, and exit surfaces of the plurality of micro exit lenses 310 may collectively form an exit surface of the second lens portion 300.

In the exemplary embodiments of the present disclosure, the plurality of micro exit lenses 310 may be formed on a surface of a second light guide 320 that is made of a light transmission material, from which light exits. However, the second light guide 320 may be omitted for similar reasons as described above in regards to the first lens portion 200.

Since each of the plurality of micro incident lenses 210 may be a lenticular lens, the light that exits from any one of the plurality of micro incident lenses 210 may be incident onto several micro exit lenses arranged in the direction in which the lenticular lenses extend among the plurality of micro exit lenses 310. However, the present disclosure is not limited thereto, and the light which exits from each of the plurality of micro incident lenses 210 may be incident onto each of the plurality of micro exit lenses 310 depending on a shape of the plurality of micro incident lenses 210.

Figure 6:
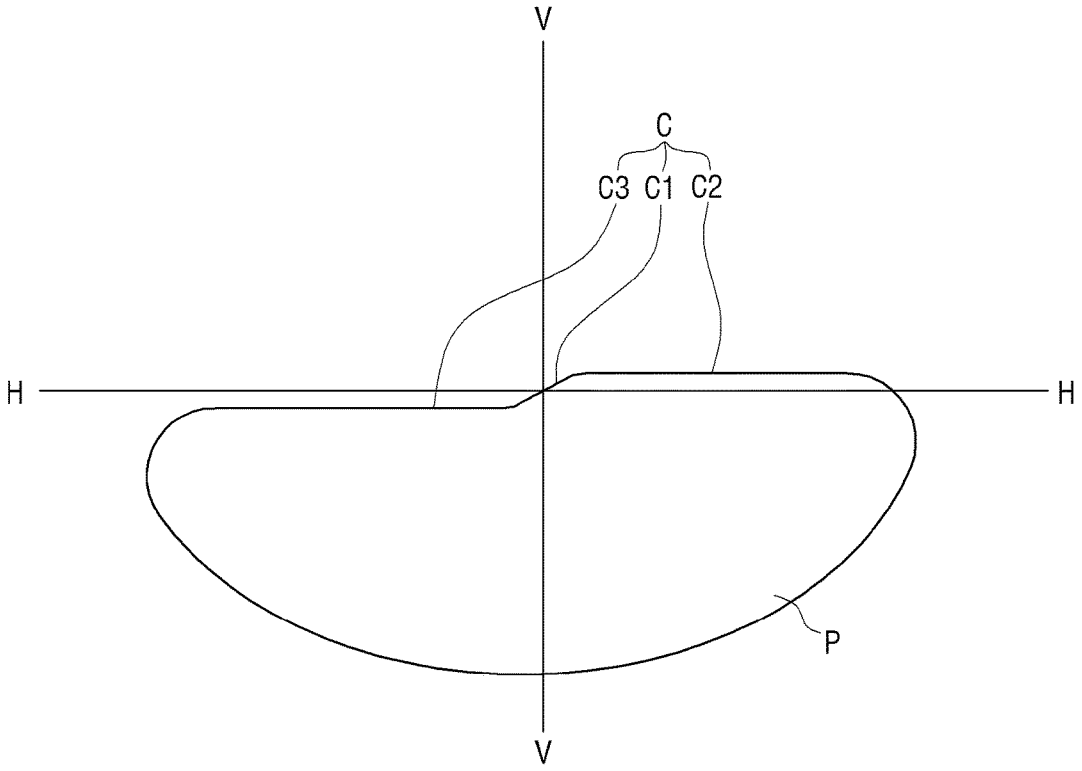
FIG. 6 is a schematic diagram illustrating a low beam pattern formed by the lamp for the vehicle according to some exemplary embodiments of the present disclosure.

The shielding portion 400 may be disposed between the first lens portion 200 and the second lens portion 300 and obstruct a portion of light which is incident onto the second lens portion 300 from the first lens portion 200 to form a cut-off line C of a beam pattern P formed by the lamp 1 according to some exemplary embodiments of the present disclosure as shown in FIG. 6. Since the lamp 1 may be a headlamp and form the low beam pattern, the shielding portion 400 may form the cut-off line C that includes an inclined edge C1, an upper edge C2, and a lower edge C3.

In particular, the upper edge C2 may be a section of the cut-off line C which corresponds to a driving lane, and the lower edge C3 may be a section of the cut-off line C which corresponds to an opposite lane. The lower edge C3 may be formed to have a height lower than that of the upper edge C2 to prevent a driver of a vehicle approaching in the opposite lane from being blinded such that the cut-off line C has a step between left and right sides thereof with respect to the inclined edge C1. A shape of the cut-off line C of the beam pattern P formed by the lamp 1 is not limited to the shape described above with reference to FIG. 6, and a shape, position, or the like of the cut-off line C may be varied based on a region or a country where this apparatus is used.

In addition, the beam pattern P of FIG. 6 may be formed by emitting light toward a screen disposed at a predetermined distance from the lamp 1 according to some exemplary embodiments of the present disclosure in front of the vehicle.

Figure 7:
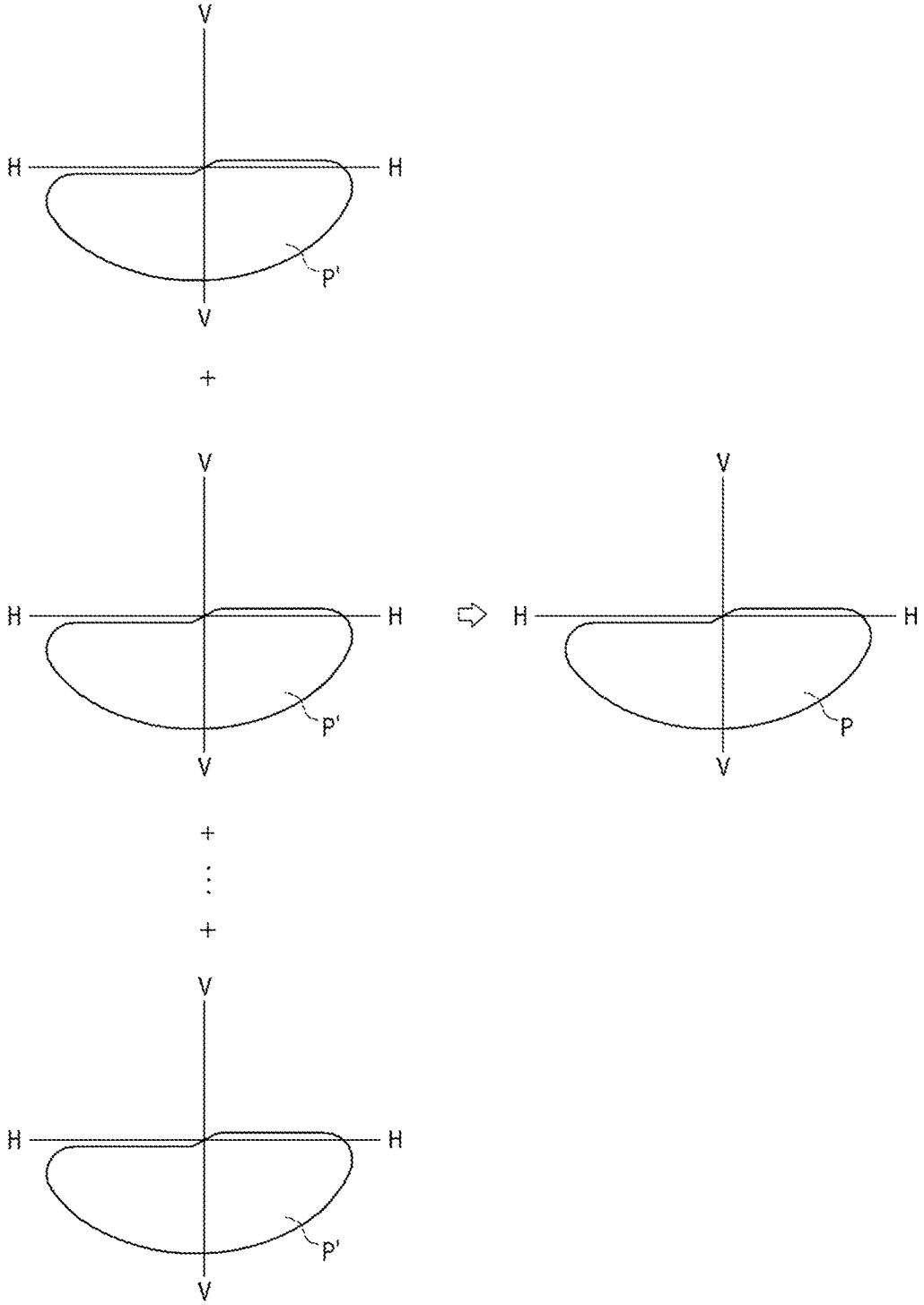
FIG. 7 is a schematic diagram illustrating a light distribution area formed by a plurality of shields according to some exemplary embodiments of the present disclosure.
Figure 8:
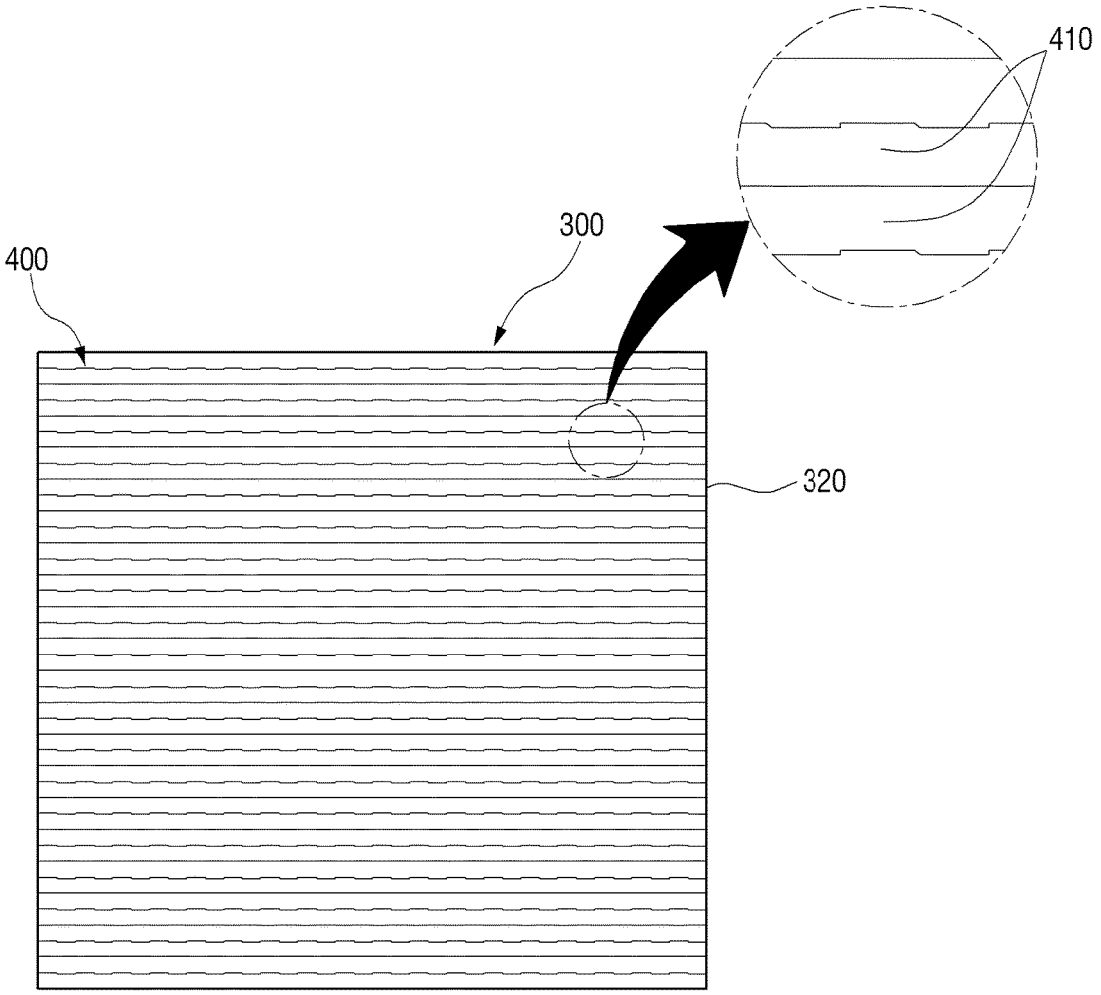
FIG. 8 is a schematic diagram illustrating a second lens portion on which a shielding portion is formed according to exemplary embodiments of the present disclosure.

The shielding portion 400 may include a plurality of shields 410 which obstruct a portion of light which is incident onto each of the plurality of micro exit lenses 310. Referring to FIG. 7, the light that exits from the plurality of micro exit lenses 310 may form a plurality of light distribution areas (e.g., illumination regions) P' to form the beam pattern P formed by the lamp 1 according to some exemplary embodiments of the present disclosure.

For example, the lamp 1 may form a low beam pattern P having one cut-off line C as described above with reference to FIG. 6 by overlapping (e.g., superimposing) the plurality of light distribution areas P' formed by each of the plurality of shields 410.

A top end of each of the plurality of shields 410 may be disposed proximate to a focal point on a rear side of each of the plurality of micro exit lenses 310 and obstruct a portion of light which is incident onto each of the plurality of micro exit lenses 310 such that the plurality of light distribution areas P' described above with reference to FIG. 6 may be formed.

Although the plurality of shields 410 may be formed on a surface of the second light guide 320 which faces the first light guide 220 by, for example, a deposition process, the present disclosure is not limited thereto, and the plurality of shields 410 may be disposed separately from the first lens portion 200 and the second lens portion 300.

Further, since each of the plurality of micro incident lenses 210 may be a lenticular lens, some of the plurality of shields 410 which partially obstruct a portion of light that exits from any one of the plurality of the micro incident lenses 210 may be integrally formed as a single body along the direction in which the lenticular lenses extend. In this case, laterally emitted light may not be obstructed such that a spreading characteristics of the beam pattern P may be improved.

In the exemplary embodiments of the present disclosure, although some of the plurality of shields 410 which correspond to the plurality of micro incident lenses 210 may be integrally formed as a single body in a horizontal direction, the present disclosure is not limited thereto and the some shields may be separately provided.

Meanwhile, at least a part of an upper boundary line of a light distribution area formed by some (e.g., a first set) of the plurality of shields 410 may be disposed separately from an upper boundary line of a light distribution area formed by the other part (e.g., a second set) of the plurality of shields 410 to allow the cut-off line C of the beam pattern P formed by the lamp 1 according to some exemplary embodiments of the present disclosure to have a moderate (e.g., adequate or appropriate amount of) sharpness.

For example, when all positions of the upper boundaries of the light distribution areas formed by the plurality of shields 410 are identical, since the upper boundary lines of the light distribution areas are disposed on the cut-off line C of the beam pattern P, the sharpness of the cut-off line C of the beam pattern P increases such that a severe contrast may occur between an area in which the beam pattern P is present and an area in which the beam pattern P is not present. In this case, a driver may be distracted, and a possibility for accidents may be increased.

Conversely, in the exemplary embodiments of the present disclosure, the cut-off line C of the beam pattern P may have a moderate sharpness to reduce the differences therebetween and to prevent the driver from being distracted such that the possibility for accidents may be reduced.

Figure 9:
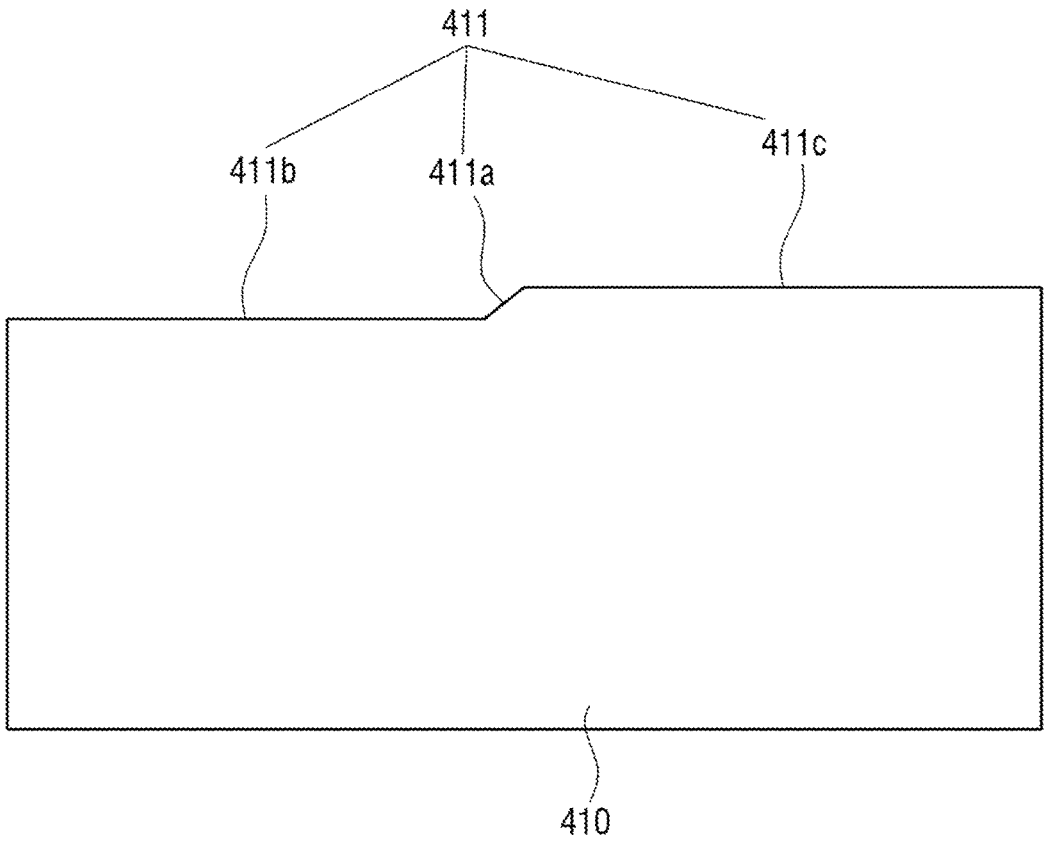
FIG. 9 is a schematic diagram illustrating the shielding portion according to some exemplary embodiments of the present disclosure.

FIG. 9 is a schematic diagram illustrating the shield according to some exemplary embodiments of the present disclosure and illustrates an example of any one of the plurality of shields 410. Referring to FIG. 9, the shield 410 may include an edge portion 411 formed on the top end thereof to form an upper boundary line of the light distribution area P'.

For example, when the edge portion 411 of the shield 410 forms an upper boundary line having a shape corresponding to the cut-off line C described above with reference to FIG. 6, the edge portion 411 may include an inclined portion 411*a*, a first obstruction edge portion 411*b*, and a second obstruction edge portion 411*c*, which form an inclined edge, an upper edge, and a lower edge of the upper boundary line, respectively.

The first obstruction edge portion 411*b* may be formed to extend from a lower end of the inclined portion 411*a* in a horizontal direction and the second obstruction edge portion 411*c* may be formed to extend from a top end of the inclined portion 411*a* in a horizontal direction such that the upper boundary line having a step between left and right sides may be formed.

In particular, positions of the first obstruction edge portion 411*b* and the second obstruction edge portion 411*c* may be opposite to positions of the upper edge and the lower edge of the upper boundary line because the light which exits from the micro incident lens 210 may pass the focal point on the rear side of the micro exit lens 310 and proceed in an opposite direction to be incident onto the micro exit lens 310 such that the light which is incident onto the micro incident lens 210 may be shown in an inverted image of that of the light which exits from the micro exit lens 310.

Here, when a position of at least one of the inclined portion 411*a*, the first obstruction edge portion 411*b*, or the second obstruction edge portion 411*c* changes, the position of the upper boundary line of the light distribution area P', which is formed by the shield 410, may change.

Accordingly, at least one of the inclined portion 411*a*, the first obstruction edge portion 411*b*, or the second obstruction edge portion 411*c* of some (e.g., a first set) of the plurality of shields 410 may have a height that is different from those of others (e.g., a second set) such that at least a portion of the cut-off line C of the beam pattern P may have a brightness which gradually changes toward a bottom thereof to provide moderate sharpness.

Figure 10:
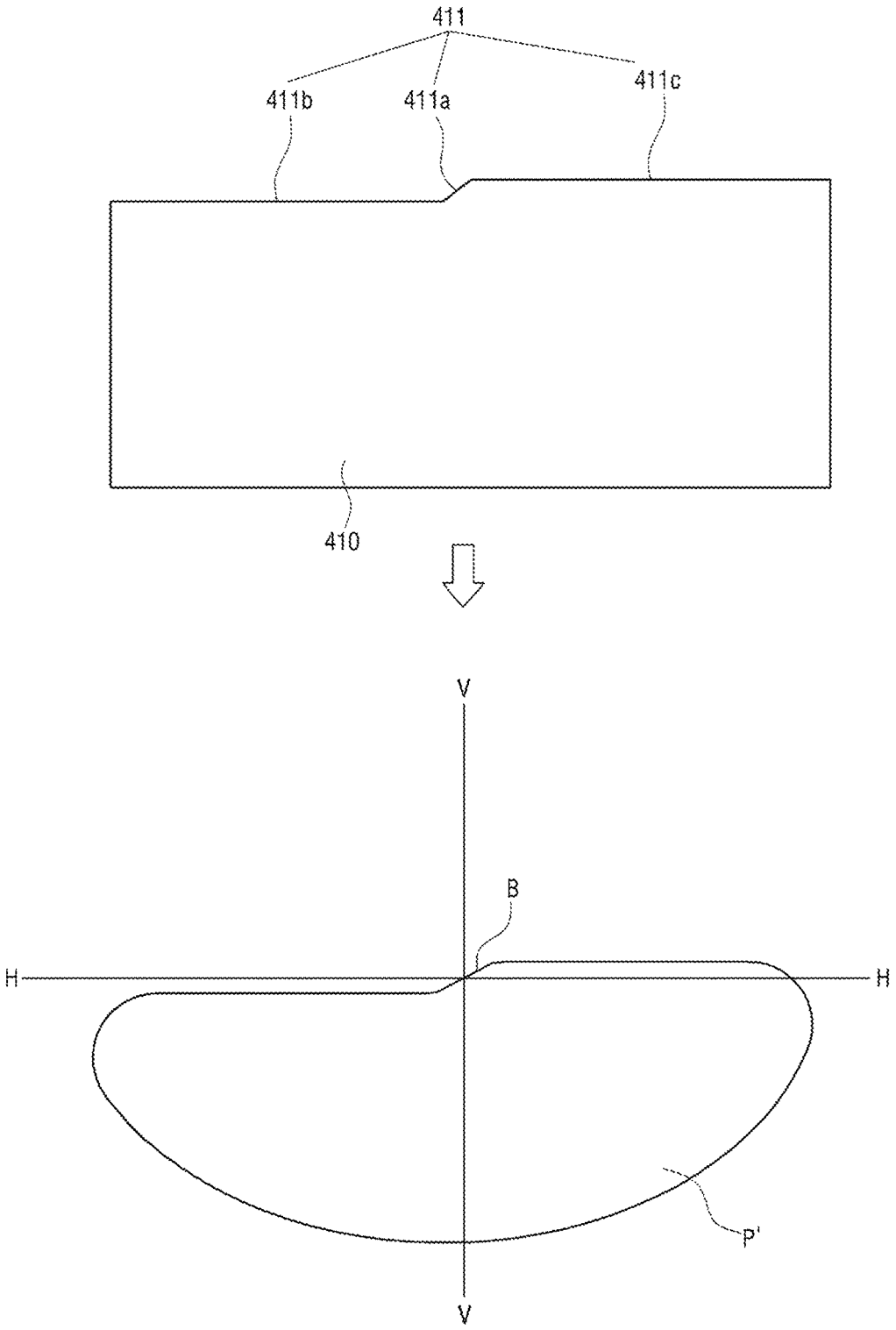
FIGS. 10 to 12 are schematic diagrams illustrating a relationship between the shields and a light distribution area according to some exemplary embodiments of the present disclosure.
Figure 11:
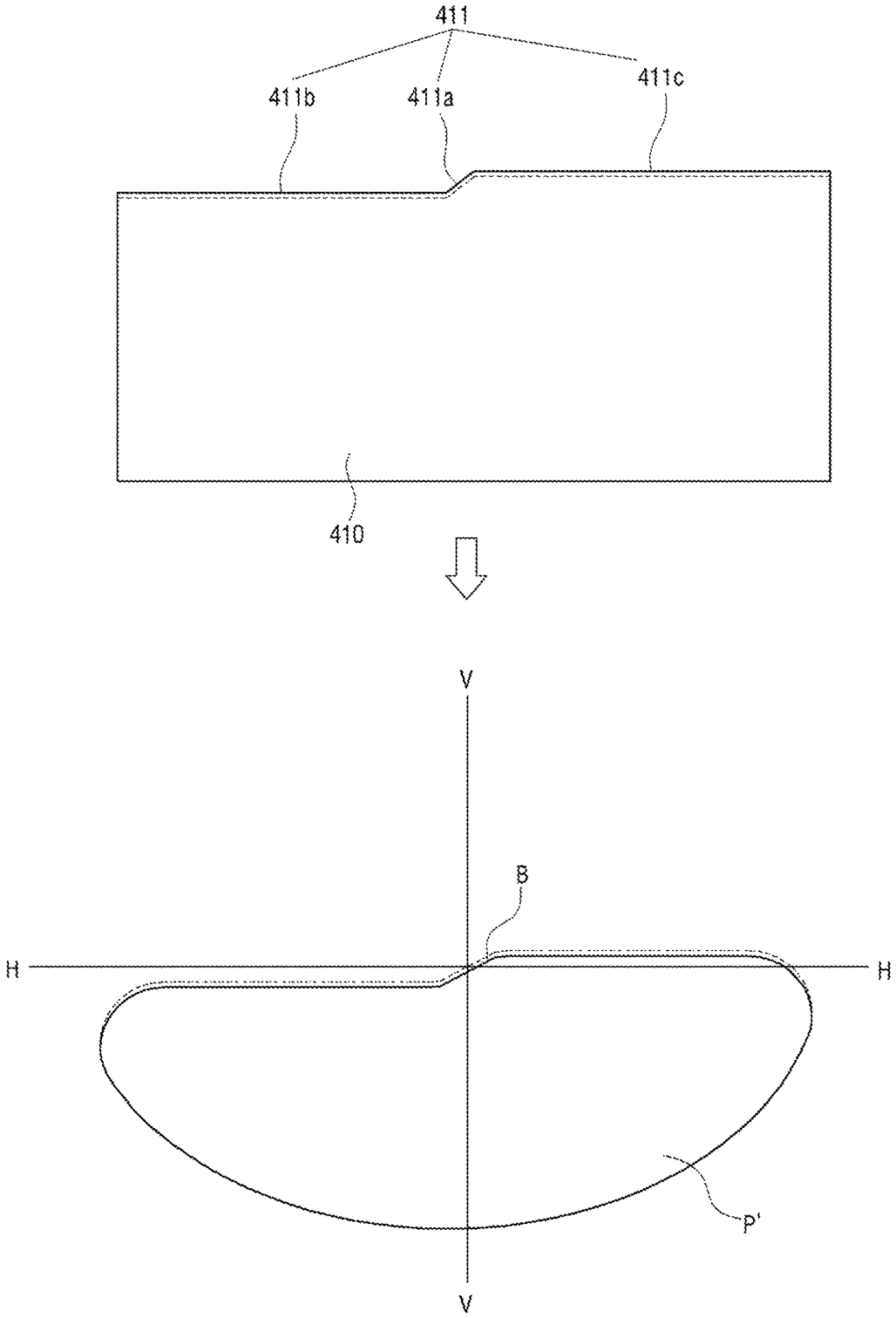
Figure 12:
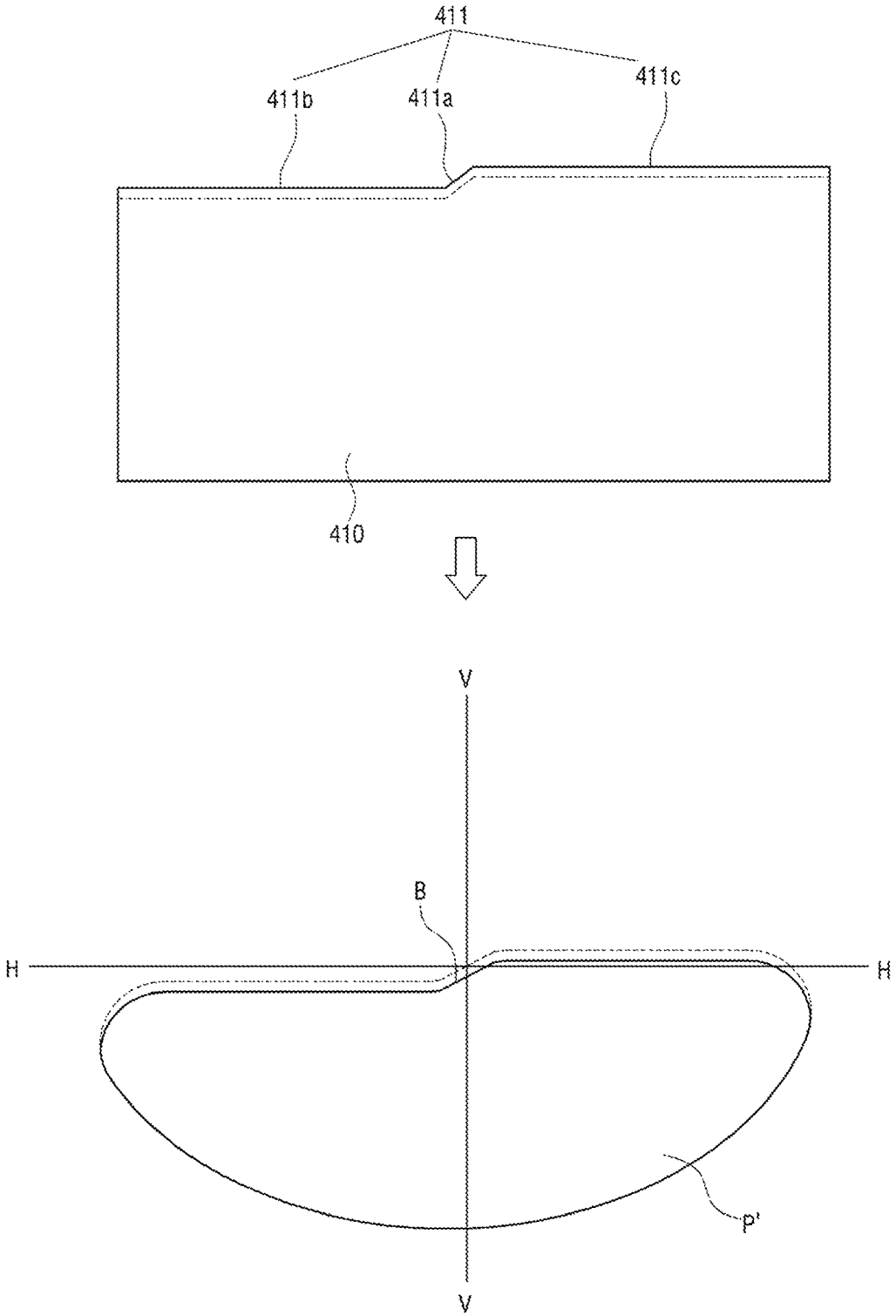

FIGS. 10 to 12 are schematic diagrams illustrating a relationship between the shields and an illuminations regions according to some exemplary embodiments of the present disclosure.

First, when it is assumed that an upper boundary line B of the light distribution area P' forms the above-described cut-off line C of the beam pattern P while the edge portion 411 of the shield 410 has a shape as shown in FIG. 10, the amount of blocked light may increase such that the upper boundary line B of the light distribution area P' may become lower than FIG. 10 when the edge portion 411 of the shield 410 becomes higher than FIG. 10 as shown in FIG. 11.

Similarly, when the edge portion 411 of the shield 410 becomes even higher than FIG. 11 as shown in FIG. 12, the amount of blocked light may further increase such that the upper boundary line B of the light distribution area P' may become even lower than FIG. 11.

Here, the dotted lines in the shield 410 and the light distribution area P' of FIGS. 11 and 12 may represent the height of the edge portion 411 and the upper boundary line in FIG. 9, which are included as reference positions of the height of the edge portion 411 of the shield 410 and the upper boundary line of the light distribution area P' shown in FIG. 10.

Figure 13:
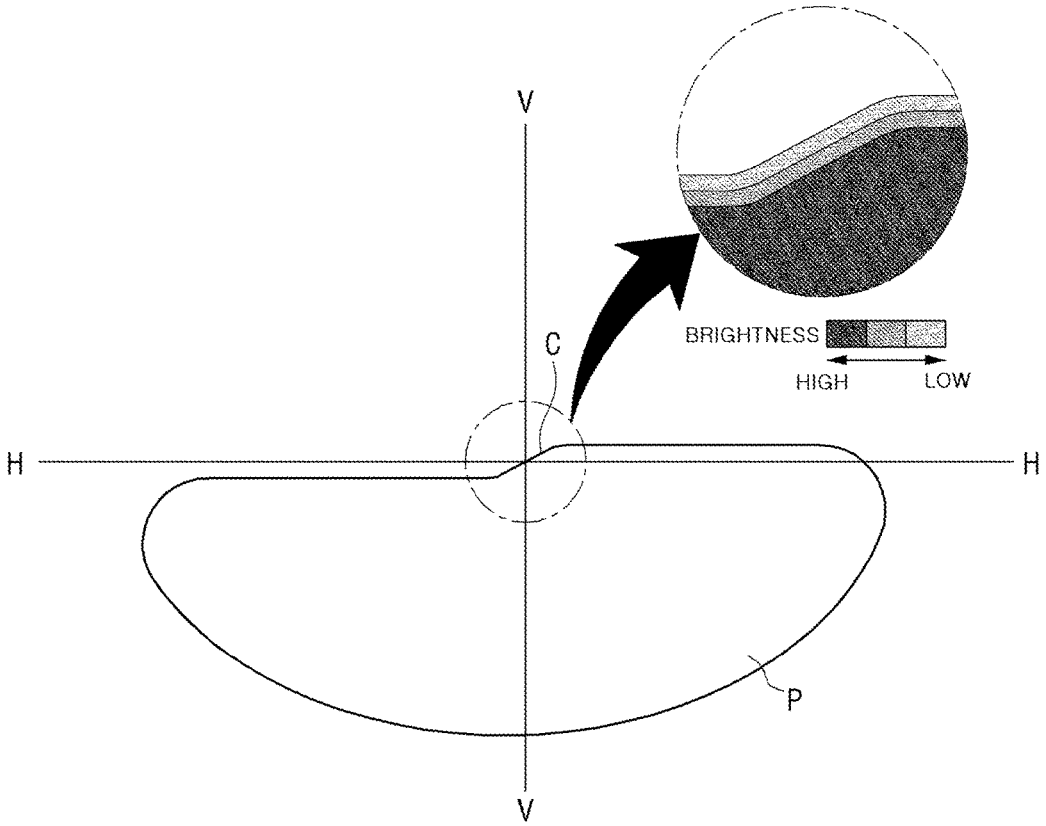
FIG. 13 is a schematic diagram illustrating a cut-off line of a beam pattern according to some exemplary embodiments of the present disclosure.

When the light distribution areas P' shown in FIGS. 10 to 12 are overlapped, the cut-off line C of the beam pattern P formed by the lamp 1 according to some exemplary embodiments of the present disclosure may have a brightness which gradually increases toward a bottom thereof such that a cut-off line C may be formed as shown in FIG. 13.

Although an example in which the overall height of the edge portion 411 of the shield 410 changes has been described, it is merely an example for aiding in understanding the present disclosure. The present disclosure is not limited thereto, and the height of any of the inclined portion 411*a*, the first obstruction edge portion 411*b*, and the second obstruction edge portion 411*c* may vary depending on which section of the cut-off line C requires a moderate sharpness.

Further, the edge portion 411 of each of the plurality of shields 410 may have at least three different heights to allow the cut-off line C to have a moderate sharpness.

In the exemplary embodiments of the present disclosure, since it may be possible to form a soft cut-off line when the beam pattern P of the lamp 1 is formed by overlapping the plurality of light distribution areas P' formed by the plurality of shields 410, the sharp contrast perceived by a driver may be reduced and the driver may be prevented from being distracted.

Additionally, one of the shields, which forms a light distribution area having an upper boundary line disposed below a line H-H among the light distribution areas P' formed by the plurality of shields 410, may include the edge portion 411 which has a flat overall shape with no step.

In the exemplary embodiments of the present disclosure, when the shields 410 have a vertically extending plate shape and a top end horizontally extending in a direction perpendicular to the optical axis of the light source portion 100, the shields 410 may be formed to have different heights such that the cut-off line C of the beam pattern P may have a moderate sharpness. However, the present disclosure is not limited thereto. Similar to the above exemplary embodiments, when the shields 410 have a horizontally extending plate shape, the shields may have front ends in different positions such that positions of the upper boundary lines of the light distribution areas P' may allow the cut-off line C of the beam pattern P to have a moderate sharpness.

Meanwhile, although a case in which the lamp 1 according to some exemplary embodiments of the present disclosure may form a single beam pattern has been descried as an example, the present disclosure is not limited thereto, and the lamp 1 according to some exemplary embodiments of the present disclosure may have different beam patterns at the same time.

Figure 14:
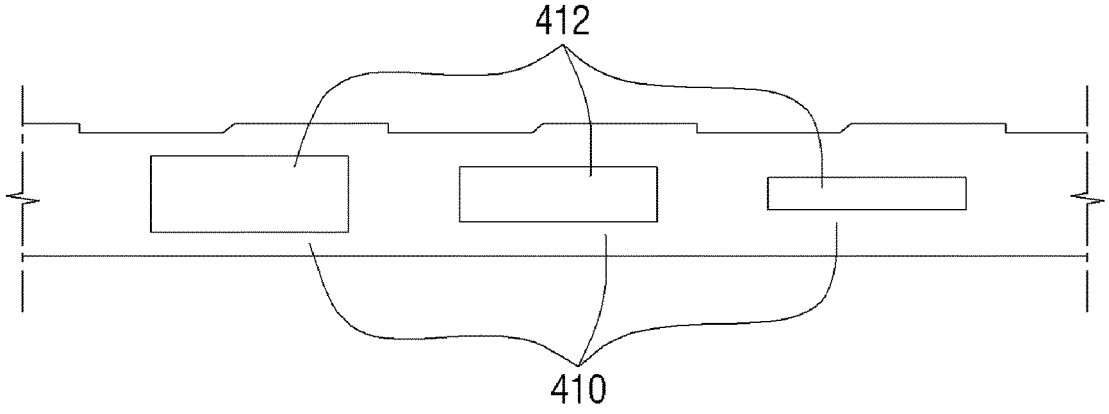
FIG. 14 is a schematic diagram illustrating a shielding portion according to other exemplary embodiments of the present disclosure.
Figure 15:
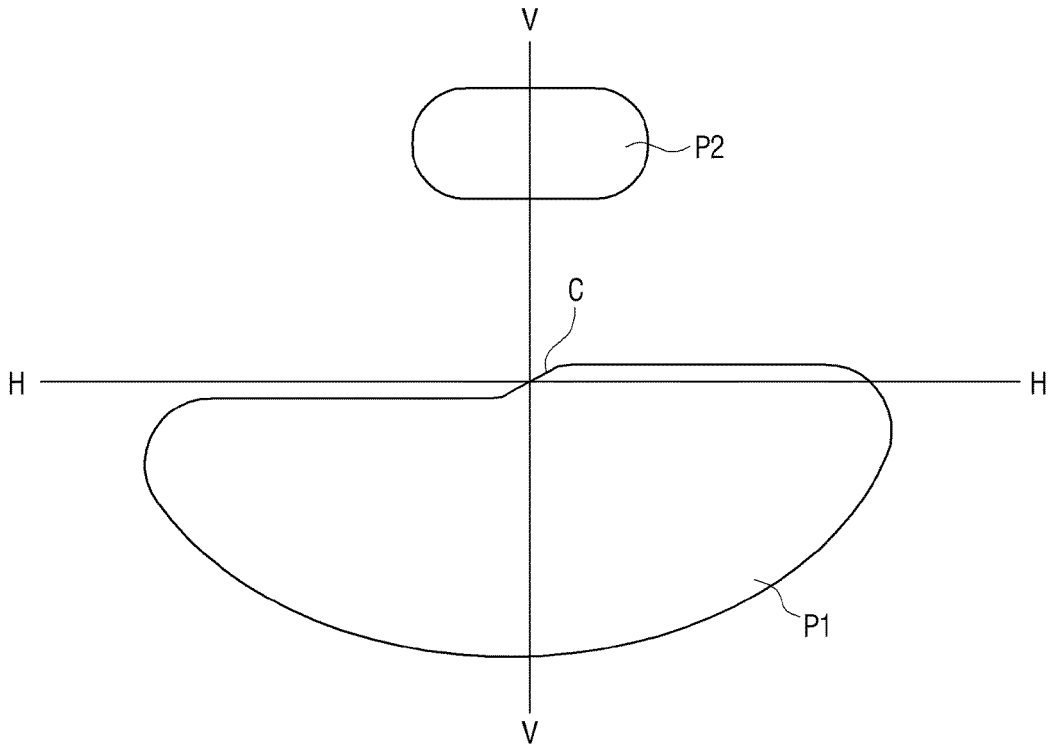
FIG. 15 is a schematic diagram illustrating a low beam pattern and a signal beam pattern according to other exemplary embodiments of the present disclosure.

FIG. 14 is a schematic diagram illustrating a shielding portion according to other exemplary embodiments of the present disclosure. Referring to FIG. 14, the shielding portion 400 may include a light transmission portion 412 which has an opening such that light passes through at least some of the plurality of shields 410 and is formed below the edge portion 411. In this case, the light transmission portion 412 may form a signal beam pattern P2 irradiated above a low beam pattern P1 to allow a driver to check a road sign and the like disposed above the driver's view as shown in FIG. 15.

Figure 16:
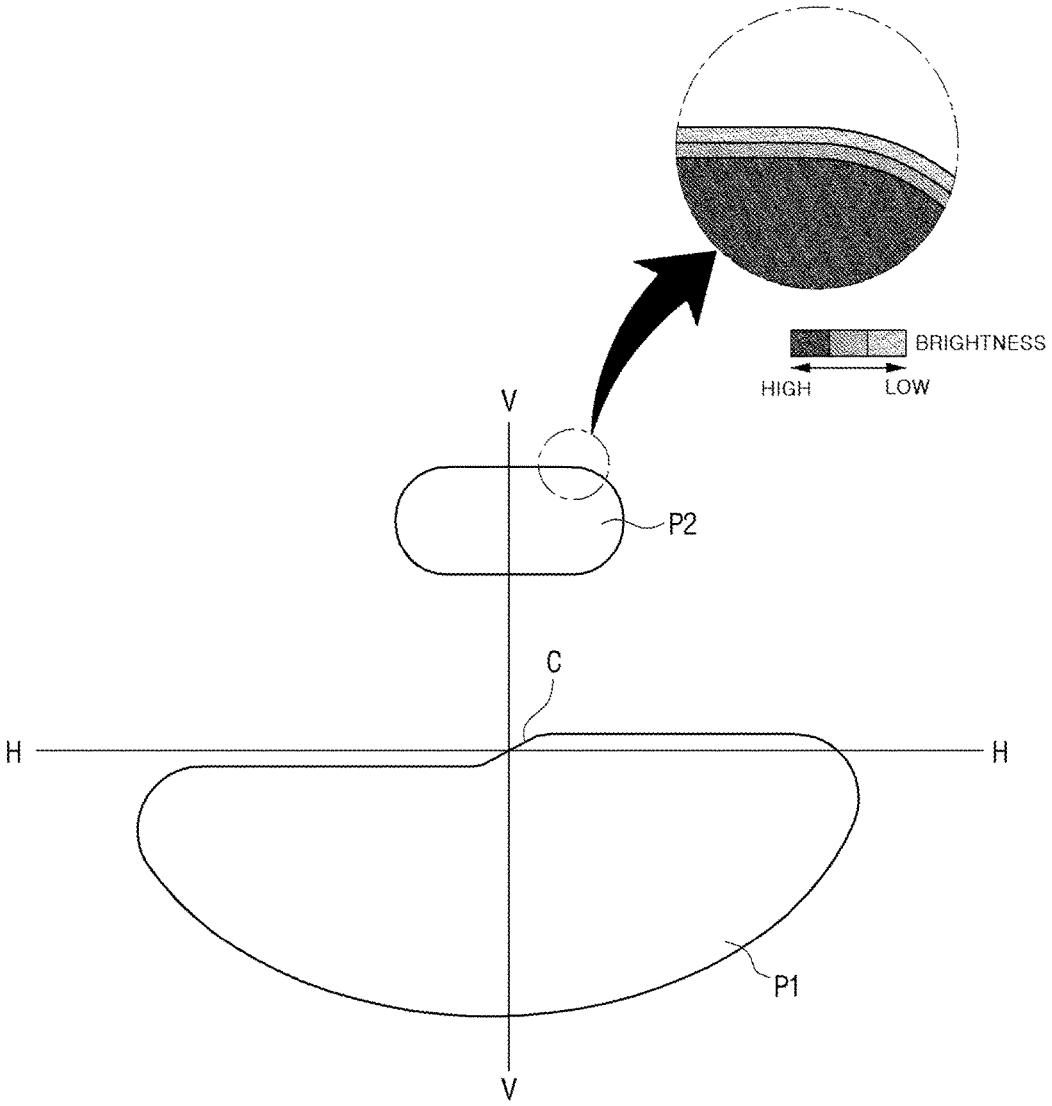
FIG. 16 is a schematic diagram illustrating a boundary line of the signal beam pattern according to other exemplary embodiments of the present disclosure.

Further, the light transmission portion 412 formed on at least some of the plurality of shields 410 may have a different size, a different shape, and/or a different position from that of the light transmission portion 412 formed on others thereof such that the brightness may gradually increase from at least part of a boundary line of the signal beam pattern P2 toward the inside to maintain moderate sharpness as shown in FIG. 16.

Additionally, at least two of the plurality of shields 410 may include the light transmission portions 412 such that the boundary line of the signal beam pattern P2 may have a moderate sharpness.

Figure 17:
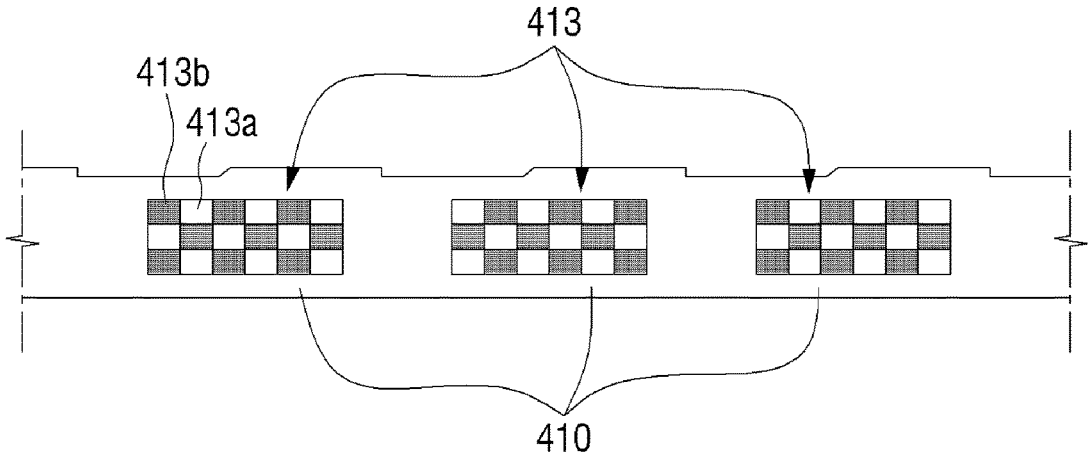
FIG. 17 is a schematic diagram illustrating a shielding portion according to still other exemplary embodiments of the present disclosure.

FIG. 17 is a schematic diagram illustrating a shielding portion according to still other exemplary embodiments of the present disclosure. Referring to FIG. 17, the shielding portion 400 may include a light transmission portion 413 which transmits light in at least some of the plurality of shields 410 may be formed below the edge portion 411, and the light transmission portion 413 may include a transmission area 413*a* which transmits light and an obstruction area 413*b* which obstructs light. The transmission area 413*a* and the obstruction area 413*b* may be alternatingly arranged in at least one direction, and at least one of the transmission area 413*a* or the obstruction area 413*b* of some (e.g., a first set) of the plurality of shields 410 may be formed in a position different from those of others (e.g., a second set) of the plurality of shields 410.

This configuration may similarly reduce a severe contrast which may occur when all areas through which the light passes to form the signal beam pattern P2 are identical, in which case the sharpness of the boundary line of the signal beam pattern P2 increases.

In addition, at least two of the plurality of shields 410 may include the light transmission portions 413 for the same reason as that of the above-described exemplary embodiments.

According to the exemplary embodiments of the present disclosure, a lamp for a vehicle may provide one or more effects as follows.

At least some of top ends of some of a plurality of shields which obstruct a portion of light, which is incident onto each of a plurality of micro exit lenses, may be formed to have heights different from those of top ends of others of the plurality of shields to form a cut-off line having a moderate sharpness such that there may be effects of reducing the perception of contrast and preventing a driver from being distracted.

In addition, an area through which light can pass may be formed in the plurality of shields such that there may be an effect of forming different beam patterns simultaneously.

Effects of the present disclosure will not be limited to the above-mentioned effects and other unmentioned effects will be clearly understood by those skilled in the art from the following claims.

It should be understood by one of ordinary skill in the art that the present disclosure can be embodied in other specific forms without changing the technical concept and essential features of the present disclosure. Therefore, the above-described embodiments should be understood to be exemplary and not limiting in every aspect. The scope of the present disclosure will be defined by the following claims rather than the above detailed description, and all changes and modifications derived from the meaning and the scope of the claims and equivalents thereof should be understood as being included in the scope of the present disclosure.

What is claimed is:

1. A lamp for a vehicle, comprising:

a light source portion;

a first lens portion which includes a plurality of micro incident lenses onto which light generated by the light source portion is incident;

a second lens portion which includes a plurality of micro exit lenses corresponding to the plurality of micro incident lenses, respectively; and a shielding portion which includes a plurality of shields configured to form a plurality of illumination regions for forming a first beam pattern by obstructing a portion of light which is incident onto each of the plurality of micro exit lenses, wherein upper boundary lines of illumination regions formed by a first set of the plurality of shields are formed in positions different from positions of upper boundary lines of illumination regions formed by a second set of the plurality of shields.

2. The lamp of claim 1, wherein the upper boundary lines of the first set of the plurality of illumination regions form a cut-off line of the first beam pattern, and wherein the upper boundary lines of the second set of the plurality of illumination regions are disposed below the cut-off line of the first beam pattern by a predetermined offset.

3. The lamp of claim 2, wherein the cut-off line of the first beam pattern has a brightness which gradually increases toward a downward direction.

4. The lamp of claim 1, wherein each of the plurality of shields includes an edge portion for forming the upper boundary line of each of the plurality of illumination regions, and at least a part of edge portions of the first set of the plurality of shields have heights different from heights of edge portions of the second set of the plurality of shields.

5. The lamp of claim 4, wherein the edge portion includes an inclined portion, a first obstruction edge portion which horizontally extends from a bottom end of the inclined portion, and a second obstruction edge portion which horizontally extends from a top end of the inclined portion, and wherein at least one of the first obstruction edge portion or the second obstruction edge portion of the edge portions of the first set of the plurality of shields have heights different from heights of the edge portions of the second set of the plurality of shields.

6. A lamp for a vehicle, comprising:

a light source portion;

a first lens portion which includes a plurality of micro incident lenses onto which light generated by the light source portion is incident;

a second lens portion which includes a plurality of micro exit lenses corresponding to the plurality of micro incident lenses, respectively; and a shielding portion which includes a plurality of shields configured to form a plurality of illumination regions for forming a first beam pattern by obstructing a portion of light which is incident onto each of the plurality of micro exit lenses, wherein each of the plurality of shields includes a light transmission portion configured to transmit light to form a second beam pattern.

7. The lamp of claim 6, wherein the first beam pattern is a low beam pattern, and the second beam pattern is a signal beam pattern formed above the low beam pattern.

8. The lamp of claim 6, wherein the light transmission portion is an open area to allow light to pass therethrough, and wherein a first set of the plurality of shields include the open area having at least one of a size, a shape, or a position different from a second set of the plurality of shields.

9. The lamp of claim 6, wherein at least part of a boundary line of the second beam pattern has a brightness which gradually increases toward an inside direction.

10. The lamp of claim 6, wherein the light transmission portion includes a transmission area which transmits light and an obstruction area which obstructs light, and wherein the transmission area and the obstruction area are alternatingly arranged in at least one direction.

11. The lamp of claim 10, wherein a first set of the plurality of shields have at least one of the transmission area or the obstruction area formed at a different position from a second set of the plurality of shields.

* * * * *